US006472961B1

(12) United States Patent
Saitoh et al.

(10) Patent No.: US 6,472,961 B1
(45) Date of Patent: Oct. 29, 2002

(54) NON-RADIATIVE DIELECTRIC LINE INCLUDING CONVEX OR CONCAVE PORTION, AND INTEGRATED CIRCUIT COMPRISING THE NON-RADIATIVE DIELECTRIC LINE

(75) Inventors: Atsushi Saitoh, Muko; Hiroshi Nishida, Kawanishi; Toru Tanizaki, Nagaokakyo; Ikuo Takakuwa, Suita, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/581,933

(22) PCT Filed: Dec. 15, 1998

(86) PCT No.: PCT/JP98/05647

§ 371 (c)(1),
(2), (4) Date: Jun. 19, 2000

(87) PCT Pub. No.: WO99/31753

PCT Pub. Date: Jun. 24, 1999

(30) Foreign Application Priority Data

Dec. 17, 1997 (JP) ..... 9-347671

(51) Int. Cl.[7] ..... H01P 3/00
(52) U.S. Cl. ..... 333/239; 333/247
(58) Field of Search ..... 333/239, 247

(56) References Cited

U.S. PATENT DOCUMENTS 5,861,782 A * 1/1999 Saitoh ..... 333/239
5,982,255 A * 11/1999 Tanizaki et al. ..... 333/239
6,031,433 A * 2/2000 Tanizaki et al. ..... 333/26

FOREIGN PATENT DOCUMENTS

JP 59183002 12/1984
JP 8-8617 1/1996
JP 8-65015 3/1996
JP 8-70206 3/1996
JP 9-102706 4/1997

OTHER PUBLICATIONS

S. Tanizaki, et al., "Ondo Tokusei o Kairyou Shita 60GHz Tai HNRD to Isolator Naizou DR–VCO", *Denshi Jouhou Tsuushin Gakkai 1997 Nen Electronics Society Taikai Kouen Rombunshuu 1*, Kouen Bangou C–2–67, p. 102, issued Aug. 13, 1997.

Y. Ishikawa, et al., "Tan'itsu Mode Densou Tokusei o Motsu Heimen kairo ketsugaugata NRD", *Denshi Jouhou Tsuushin Gakkai 1996 Nen Sougou Taikai Kouen Rombunshuu Electronics 1*, Kouen Bangou C–169, p. 169, issued Mar. 11, 1996.

* cited by examiner

*Primary Examiner*—Robert Pascal
*Assistant Examiner*—Joseph Chang
(74) *Attorney, Agent, or Firm*—Ostrolenk, Faber, Gerb & Soffen, LLP

(57) ABSTRACT

In a non-radiative dielectric line, slots opposing each other are respectively formed on two conductive plates and a dielectric strip is disposed within both the slots to form a NRD guide. Convex portions "P" protruding in the lateral direction to the propagating direction of an electromagnetic wave are formed at a predetermined position of the dielectric strip 3 while concave portions "H" are formed on internal surfaces of the slots in the conductive plates 1 and 2 so as to mate the both of them with each other. Variations in characteristics due to the positional slippage of the dielectric strip and so forth are prevented, and even when the dielectric strip is produced by machining, etc., the process is easily performed. Characteristics as a transmission line are also maintained without disturbing the electromagnetic field distribution in a mode to be propagated.

9 Claims, 15 Drawing Sheets

WHEN RADIUS OF CURVATURE R=0.5 mm

WHEN RADIUS OF CURVATURE R=0.6 mm

WHEN RADIUS OF CURVATURE R=0.7 mm

WHEN RADIUS OF CURVATURE R=0.8 mm

NON-RADIATIVE DIELECTRIC LINE INCLUDING CONVEX OR CONCAVE PORTION, AND INTEGRATED CIRCUIT COMPRISING THE NON-RADIATIVE DIELECTRIC LINE

TECHNICAL FIELD

The present invention relates to a non-radiative dielectric line and an integrated circuit thereof suitable for a transmission line or a circuit used in a millimetric wave frequency band or a microwave frequency band.

BACKGROUND ART

Hitherto, a dielectric line in which, as shown in FIG. 26, a dielectric strip 3 is disposed between two conductive plates 1 and 2 approximately parallel with each other has been used as a dielectric line in a millimetric wave frequency band or a microwave frequency band. In particular has been developed a non-radiative dielectric line (referred to an NRD guide below) in which the propagation area is arranged within only a dielectric strip portion by reducing the spacing between the conductive plates to have no more than a half-wave length of the propagation wavelength of an electromagnetic wave.

When such the NRD guide is formed, PTFE is mainly used for the dielectric strip while hard aluminum is mainly used for the conductive plate. However, since the coefficients of linear expansion of these materials are largely different, a problem that the dielectric strip slips relatively from the conductive plate during the cycle of temperatures has risen. Therefore, a structure for fixing the dielectric strip slip to the conductive plate is important in the point of weather resistance.

In forming a millimetric wave circuit module by combining several components using NDR guides, when the NDR guides are connected to each other between the components, positioning of each of the NDR guides for connecting to each other is required.

Therefore, as shown in FIG. 27, a conventional fixing structure of the dielectric strip, in which a protruding portion is formed at a predetermined position of the dielectric strip while an associated hollow portion is formed in the conductive plate such that both portions are mated with each other, is disclosed in Japanese Unexamined Patent Publication No. 08-8617.

On the other hand, NRD guide, in which slots are formed on respective surfaces, opposing each other, of the conductive plates and a dielectric strip is disposed between the slots, such that only a single mode of an LSM01 mode can be transmitted, is disclosed in Japanese Unexamined Patent Publication No. 09-102706.

In the NRD guide having the structure shown in FIG. 27, it is advantageous that the dielectric strip be directly disposed between the conductive plates by a method such as injection molding; however when the dielectric strip is manufactured by a method such as cutting, the processing is difficult to perform. The larger the protruding portion of the dielectric strip 3 in size, the more securely it is mated with the conductive plate; however when it is too large, the electromagnetic field distribution is disturbed, generating reflections, so that characteristics as a transmission line may result in problems.

In the above-mentioned NRD guide having the conductive plates with slots formed thereon, the dielectric strip is positioned by mating with the slots of the conductive plates in the direction orthogonal to the propagating direction of the electromagnetic wave. However, the dielectric strip cannot be fixed in the propagating direction of the electromagnetic wave, which may result in the dielectric strip slipping in the propagating direction of the electromagnetic wave due to variations in ambient temperature, etc.

DISCLOSURE OF INVENTION

Accordingly, it is an object of the present invention to provide a non-radiative dielectric line and an integrated circuit using the same by solving the above-mentioned problems.

A non-radiative dielectric line according to the present invention comprises: two conductive plates approximately parallel to each other, slots opposing each other being respectively formed on the two conductive plates; and a dielectric strip disposed between both the slots, wherein convex portions protruding in the lateral direction to the propagating direction of an electromagnetic wave or concave portions recessed in the lateral direction to the propagating direction of an electromagnetic wave are formed at a predetermined position of the dielectric strip while concave portions or convex portions mating with the convex portions or the concave portions, respectively, of the dielectric strip are formed on internal surfaces of the slots in the two conductive plates.

Owing to this structure, the dielectric strip is fixed in the propagating direction of the electromagnetic wave by mating of the convex portions or the concave portions of the dielectric strip with internal surfaces of the slots of the conductive plates, while being fixed in the direction orthogonal to the propagating direction of the electromagnetic wave by mating with the slots of the conductive plates.

In another aspect of a non-radiative dielectric line, corner portions of the concave portions or the convex portions in the dielectric strip or in the slots of the two conductive plates may have a curved surface shape. For example, in forming corner portions of the concave portions or the convex portions in the dielectric strip or in the slots of the conductive plates to have a curved surface shape equivalent to part of a cylindrical surface, when the dielectric strip is cut from a PTFE plate with an end mill, the dielectric strip having the concave portions or the convex portions with corner portions having a cylindrical surface corresponding to the radius of the end mill can be easily formed. Likewise, when the slot of the conductive plate is formed with the end mill, the concave portion or convex portion with corner portions having a cylindrical surface corresponding to the radius of the end mill can be easily formed on the internal surface of the slot of the conductive plate.

In a further aspect of a non-radiative dielectric line, the dielectric strip is divided into two strips along a surface parallel to the propagating direction of the electromagnetic wave, wherein a gap between end faces of the two divided dielectric strips has a length which is an odd-number multiple of approximately one quarter of the guide wavelength of the electromagnetic wave propagating through the dielectric strip while the two divided dielectric strips are respectively mated with the two conductive plates by the convex portions or the concave portions.

Owing to this structure, in the connecting portion of non-radiative dielectric lines, reflected waves in each connecting surface between the dielectric strips cancel each other by being superimposed out of phase with each other, such that the effect of the reflection is reduced. Even when the two divided dielectric-strips move relative to the conductive plates due to variations in temperature, since the length of each gap produced therein is the same, the effect of the reflection is reduced regardless of variations in ambient temperature.

An integrated circuit of non-radiative dielectric lines according to yet another aspect of the invention comprises a plurality of the above-mentioned non-radiative dielectric lines, wherein the plurality of non-radiative dielectric lines are connected to each other. Owing to this structure, since the positional relationship between the plurality of non-radiative dielectric lines can be maintained to be stable, an integral circuit having small variations in characteristics due to variations in assembly accuracy and to variations in ambient temperature after assembling can be obtained.

BEST MODE FOR CARRYING OUT THE INVENTION

Figure 1:
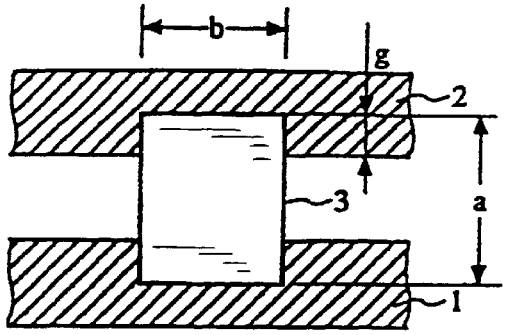
FIG. 1 is a drawing of a sectional structure of an NRD guide according to an embodiment of the present invention.

FIG. 1 is a drawing of a sectional structure of an NRD guide according to an embodiment of the present invention. In the drawing, numerals 1 and 2 denote conductive plates, in which slots are formed on respective surfaces opposing each other while a dielectric strip 3 is disposed between both the slots. When designed in a frequency band of 60 GHz, the size of each part of the NRD guide is as follows: a=2.2 mm; b=1.8 mm; g=0.5 mm.

Figure 2A:
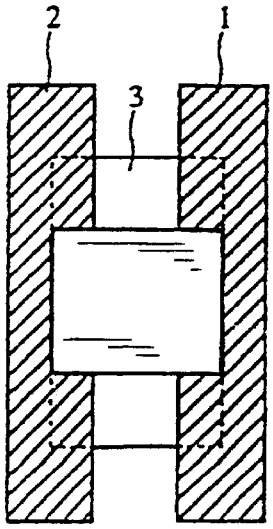
FIG. 2 is a drawing of a structure of an NRD guide according to a first embodiment of the present invention.
Figure 2B:
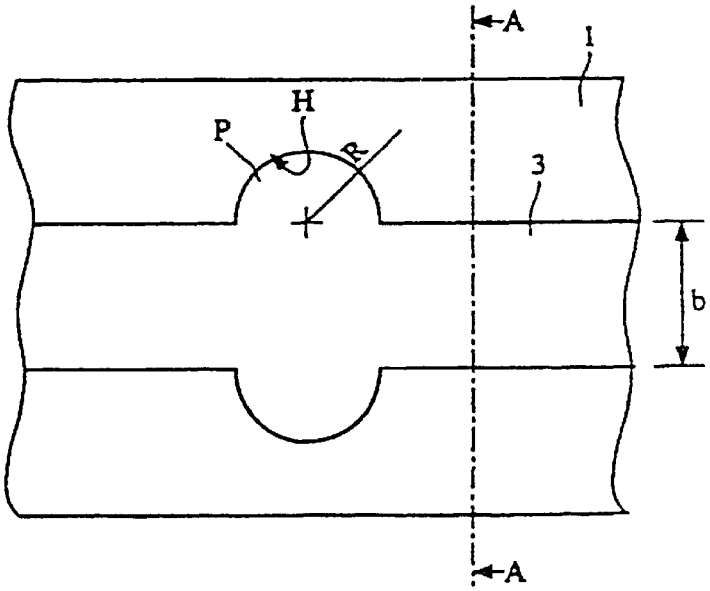
Figure 3:
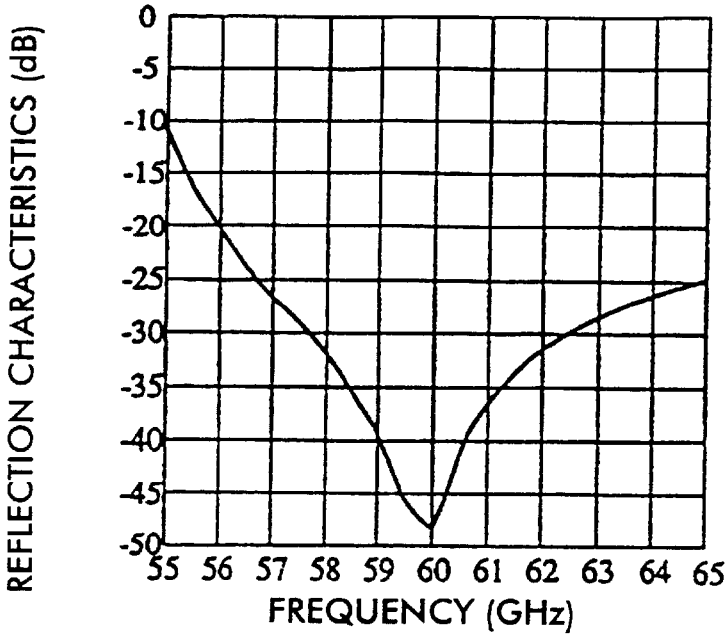
FIG. 3 is a graph showing reflection characteristics of the NRD guide shown in FIG. 2.
Figure 4:
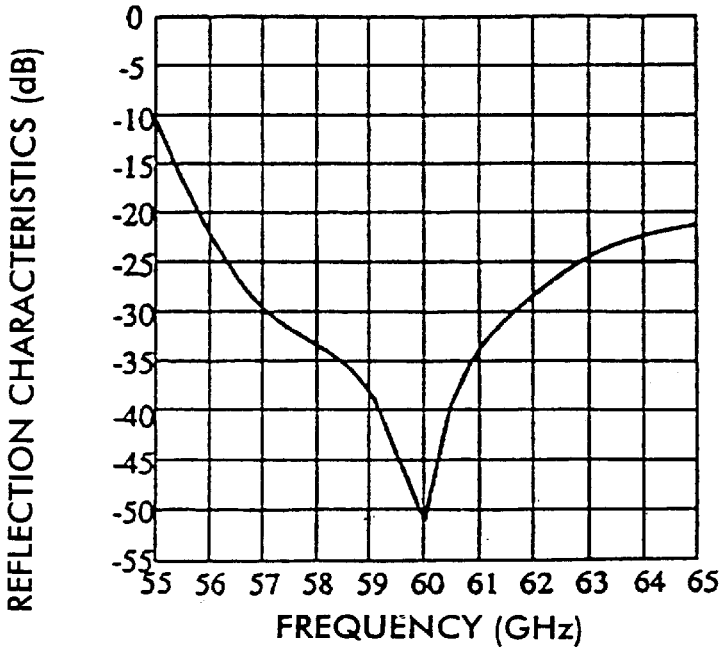
FIG. 4 is a graph showing reflection characteristics of the NRD guide shown in FIG. 2.
Figure 5:
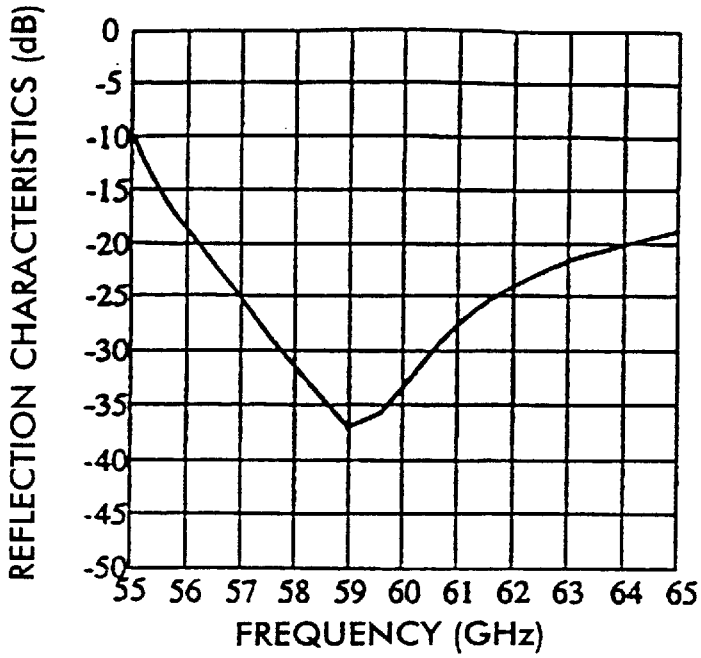
FIG. 5 is a graph showing reflection characteristics of the NRD guide shown in FIG. 2.
Figure 6:
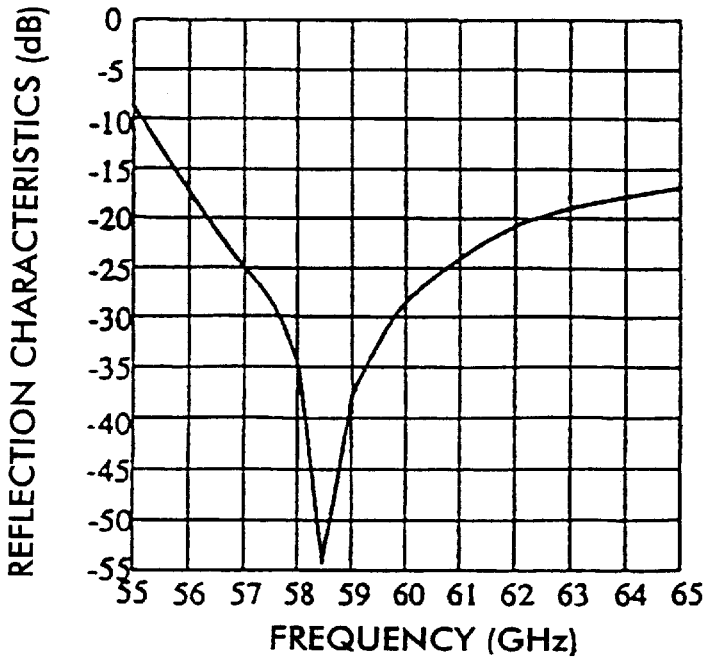
FIG. 6 is a graph showing reflection characteristics of the NRD guide shown in FIG. 2.

FIG. 2 includes a sectional view of the NRD guide and a plan view in a state that the upper conductive plate is removed. FIG. 2A is a sectional view at the line A—A of FIG. 2B. At predetermined positions of the dielectric strip 3 are formed convex portions "P" protruding to both sides in the lateral direction and having a radius of curvature "R". On internal surfaces of the conductive plate 1, concave portions "H" are formed associated with the convex portions. The shape of the slot of the upper conductive plate 2 is the same as that of the conductive plate 1.

The results of transmission characteristics (reflection characteristics) of the NRD guide shown in FIGS. 1 and 2, obtained by a three dimensional finite-element-method analysis are shown in FIGS. 3 to 6, under conditions that a specific dielectric constant of the dielectric strip 3 is 2.04 and when the radius of curvature "R" of the convex portion of the dielectric strip is respectively changed to be: 0.5 mm; 0.6 mm; 0.7 mm; and 0.8 mm. In this manner, when the size of the convex portion of the dielectric strip is small, the convex portion has little effect thereon, such that it is understood that excellent reflection characteristics can be obtained in a designed frequency band of 60 GHz. It is also understood that the frequency band capable of low-loss transmission with scarce reflection is changed by the radius of curvature "R". That is, the larger the radius of curvature "R" of the convex portion formed in the dielectric strip, the smaller the frequency band with the minimum reflection is inclined to become. However, even when the radius of curvature "R" is increased to be 0.8 mm just like this example, the NRD guide can be still used in a frequency band of 60 GHz.

Then, the structure of an NRD guide according to a second embodiment will be described with reference to FIGS. 7 and 8.

While the first embodiment was described in the context of the transmission line for a millimetric wave in which the dielectric strip is disposed between the two conductive plates, in the second embodiment, a substrate and the dielectric strip as well are arranged between two conductive plates to form a millimetric wave circuit. FIG. 7 is a sectional view thereof. In the drawing, numeral 4 denotes a dielectric substrate while numerals 31 and 32 represent respective dielectric strips, wherein the dielectric substrate 4 is arranged so as to be sandwiched between the two conductive plates 1 and 2 via the dielectric strips 31 and 32. In this example, in order to arrange the dielectric substrate 4 at the intermediate position, the upper and lower dielectric strips 31 and 32 have the same shape.

Figure 7:
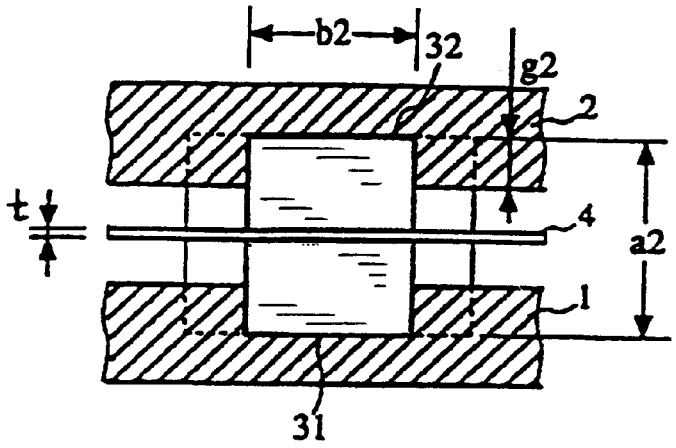
FIG. 7 is a sectional view showing a structure of an NRD guide according to a second embodiment.
Figure 8:
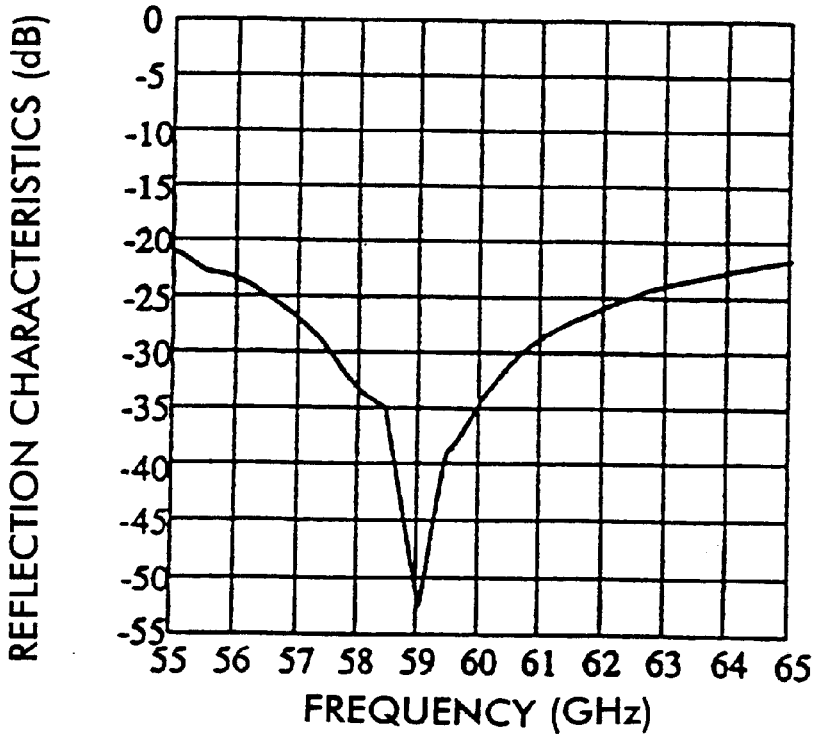
FIG. 8 is a graph showing reflection characteristics of the NRD guide according to the second embodiment.

The result of a three dimensional finite-element-method analysis is shown in FIG. 8, under conditions that dimensions shown in FIG. 7 are: a2=2.2 mm; b2=1.8 mm; g2=0.5 mm; and t=0.1 mm, a specific dielectric constant of the dielectric strips 31 and 32 is 2.04, a specific dielectric constant of the dielectric substrate 4 is 3.5, and the convex portions formed in the dielectric strips 31 and 32 have the same shape as that shown in FIG. 2 in which a radius of curvature "R" is 0.55 mm. From this result, it is understood that in the NRD guide in which the substrate is disposed, the dielectric strips can also be fixed in a predetermined frequency band without deteriorating reflection characteristics.

Then, the structure of an NRD guide according to a third embodiment will be described with reference to FIGS. 9 and 10.

While in the first and second embodiments are formed the convex portions protruding from the dielectric strip and having a semi-circular shape, in the third embodiment, corner portions of the convex portions in the dielectric strip and the concave portions on internal surfaces of slots of the conductive plates have a smoothly curved surface shape. In FIG. 9, the convex portion "P" of the dielectric strip 3 has a curvature (cylindrical surface) connecting two arcs having radii of curvature "R1" and "R2". When the dielectric strip 3 is cut from a PTFE plate with an end mill, milling can be performed by approximately equalizing the radius of curvature "R2" to the radius of the end mill or making it larger than the radius of the end mill. By equalizing the "R2" to the radius of the end mill, the processing time can be reduced, resulting in reduced processing cost. On the other hand, as for cutting of slots of the conductive plates, milling with an end mill can be easily performed by forming corner portions of the concave portion "H" to have a partial cylindrical surface. This can be achieved by equalizing the radius of curvature "R1" to the radius of the end mill or making it larger than that.

Figure 9A:
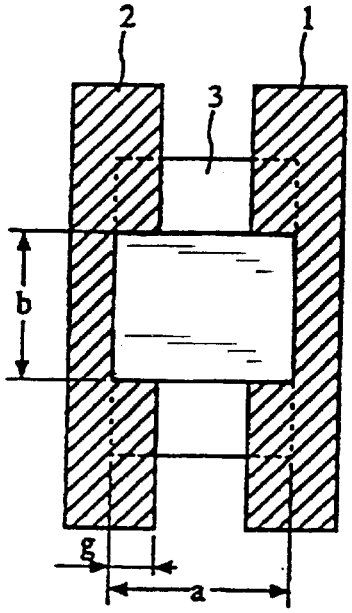
FIGS. 9A and 9B are drawings of a structure of an NRD guide according to a third embodiment.
Figure 9B:
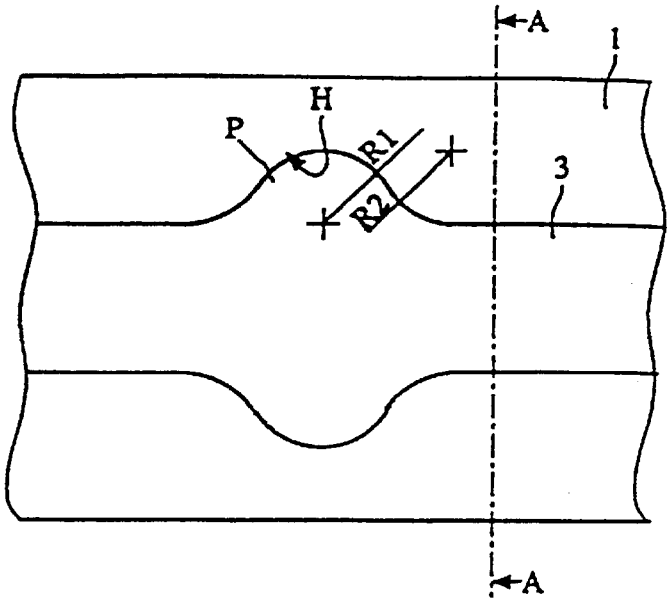
Figure 10:
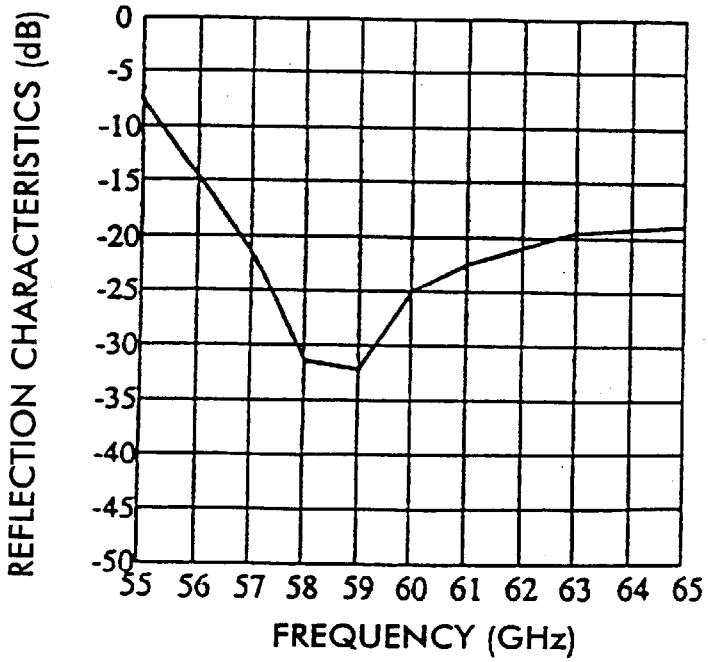
FIG. 10 is a graph showing reflection characteristics of the NRD guide according to the third embodiment.

The result of a three dimensional finite-element-method analysis is shown in FIG. 10 under conditions that dimensions shown in FIG. 9 are: a=2.2 mm; b=1.8 mm; and g=0.5 mm, a specific dielectric constant of the dielectric strip 3 is 2.04, the radius of curvature "R1" is 0.8 mm, and the "R2" is 1.0 mm. In this manner, when corner portions of the convex and concave portions respectively formed in the dielectric strip and the slots of the conductive plates have a curved surface, the desired reflection characteristics can also be obtained.

Then, the structures of NRD guides according to a fourth and a fifth embodiment will be described with reference to FIGS. 11 to 14.

Figure 11A:
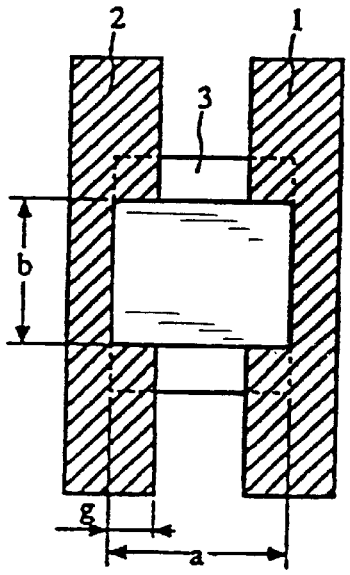
FIGS. 11A and 11B are drawings of a structure of an NRD guide according to a fourth embodiment.
Figure 11B:
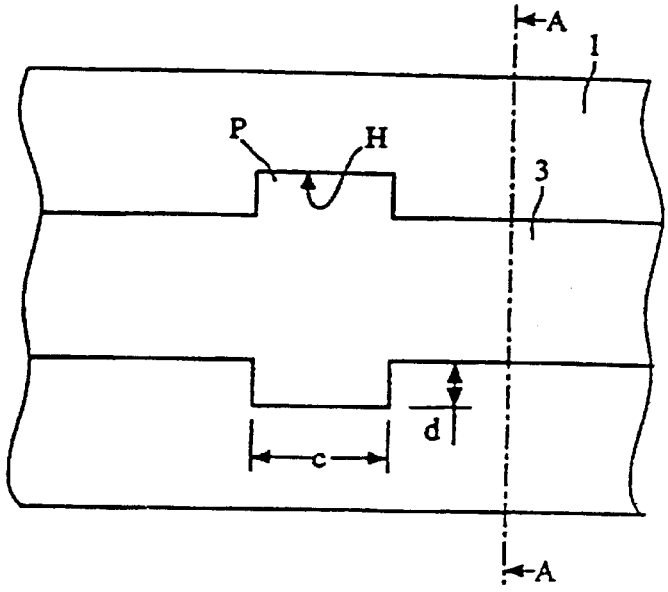
Figure 13A:
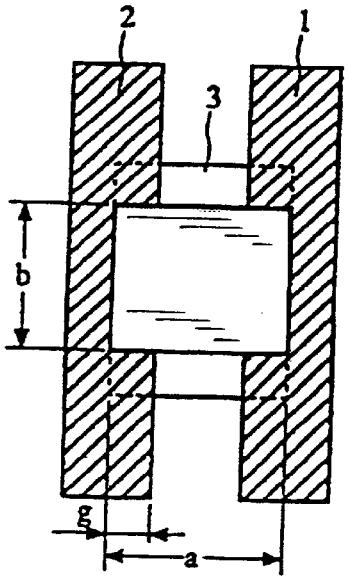
FIGS. 13A and 13B are drawings of a structure of an NRD guide according to a fifth embodiment.
Figure 13B:
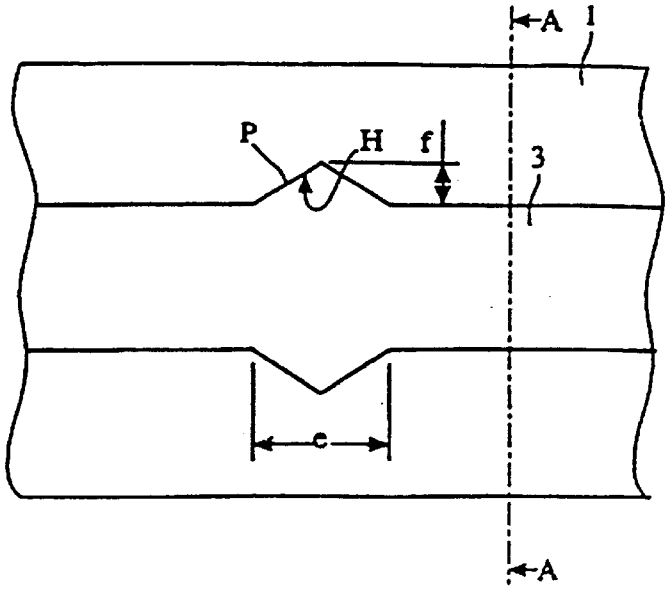

While in the first to third embodiments, the convex portions in the dielectric strip and the concave portions on internal surfaces of slots of the conductive plates have a curved surface, convex portions "P" having a rectangular planner shape may be formed and corresponding concave portions "H" may be formed on internal surfaces of slots of the conductive plates, as shown in FIG. 11. As shown in FIG. 13, convex portions "P" having a triangular planner shape may be formed and corresponding concave portions "H" may be formed on internal surfaces of slots of the conductive plates.

Figure 12:
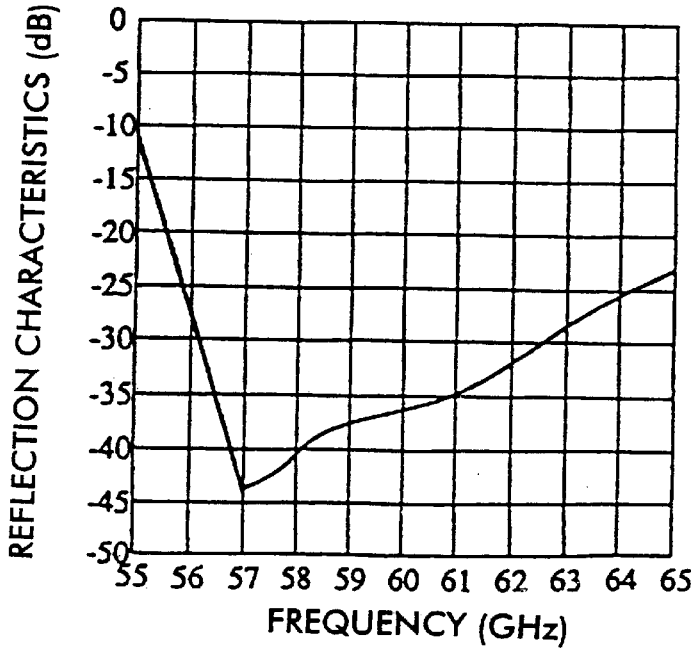
FIG. 12 is a graph showing reflection characteristics of the NRD guide according to the fourth embodiment.
Figure 14:
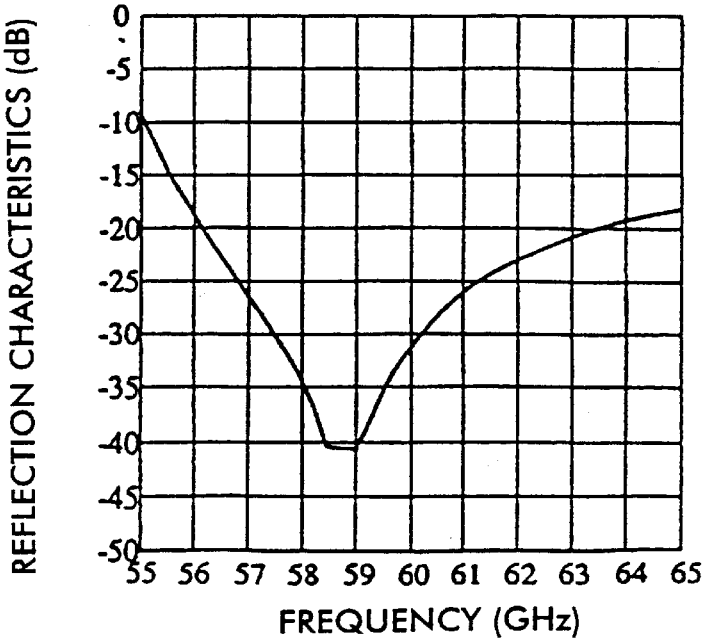
FIG. 14 is a graph showing reflection characteristics of the NRD guide according to the fifth embodiment.

The result of a three dimensional finite-element-method analysis is shown in FIG. 12 under conditions that dimensions shown in FIGS. 11 and 13 are: a=2.2 mm; b=1.8 mm; and g=0.5 mm, a specific dielectric constant of the dielectric strip 3 is 2.04, and sizes of the convex portion of the dielectric strip shown in FIG. 11 are: c=0.6 mm; and d=0.8 mm. The result of a three dimensional finite-element-method analysis is shown in FIG. 14 under conditions that sizes of the convex portion of the dielectric strip shown in FIG. 13 are: e=2.0 mm; and f=0.8 mm. In this manner, in any of examples, excellent reflection characteristics can be obtained in a predetermined frequency band.

Figure 15A:
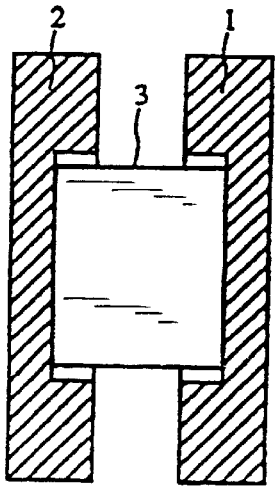
FIGS. 15A and 15B are-drawings of a structure of an NRD guide according to a sixth embodiment.
Figure 15B:
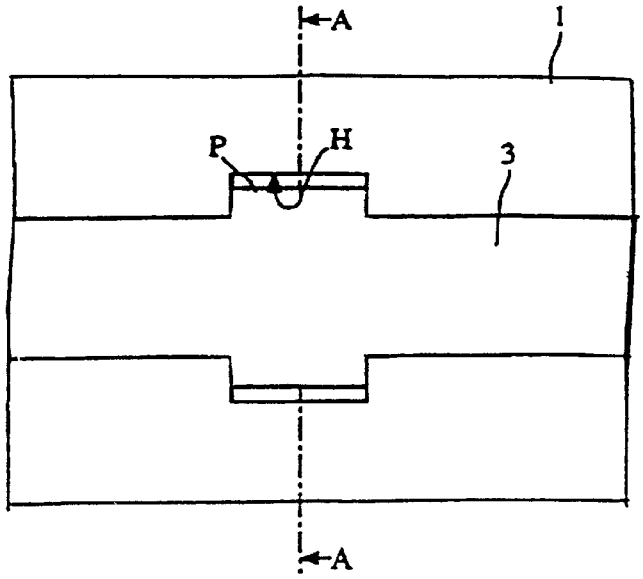

FIG. 15 is a drawing of a structure of an NRD guide according to a sixth embodiment. In this embodiment, a clearance between the convex portion "P" formed in the dielectric strip and the concave portions "H" formed on internal surfaces of slots of the conductive plates 1 and 2 is created in the lateral direction of the dielectric strip 3. Even the guide has such the structure, the dielectric strip 3 can be fixed to the conductive plates 1 and 2.

Figure 16A:
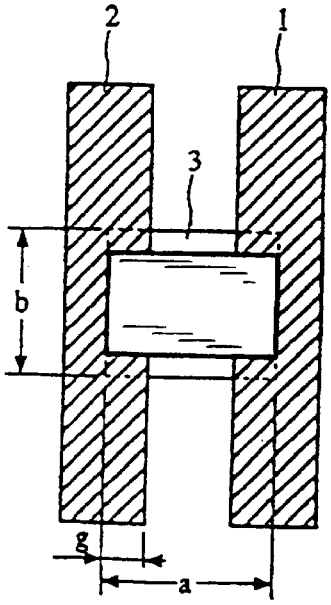
FIGS. 16A and 16B are drawings of a structure of an NRD guide according to a seventh embodiment.
Figure 16B:
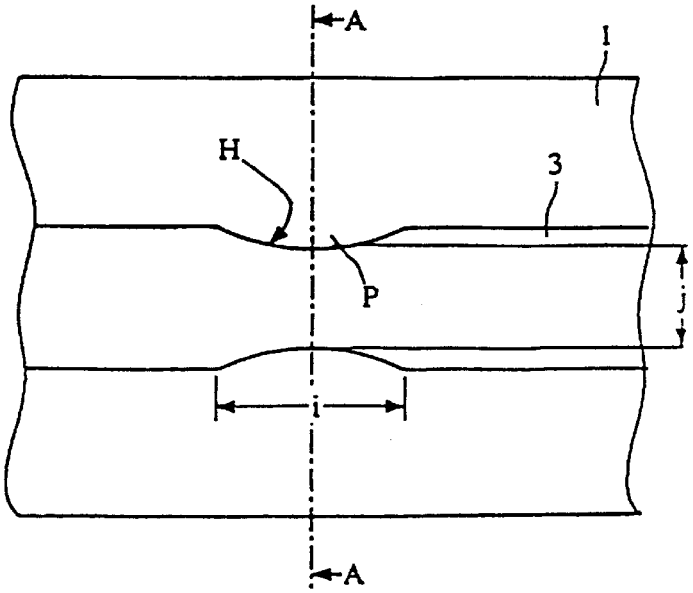

FIG. 16 is a drawing of a structure of an NRD guide according to a seventh embodiment. While in the first to sixth embodiments, the convex portions protruding in the lateral direction of the dielectric strip 3 are formed therein, in the seventh embodiment, concave portions "H" oppositely recessed in the lateral direction of the dielectric strip 3 are formed therein and corresponding convex portions "P" are formed on internal surfaces of slots of the conductive plates 1 and 2. Even the guide has such the structure, reflection characteristics can be effectively maintained by determining a size (radius of curvature) of the concave portion "H" of the dielectric strip 3 within the predetermined range.

Figure 17:
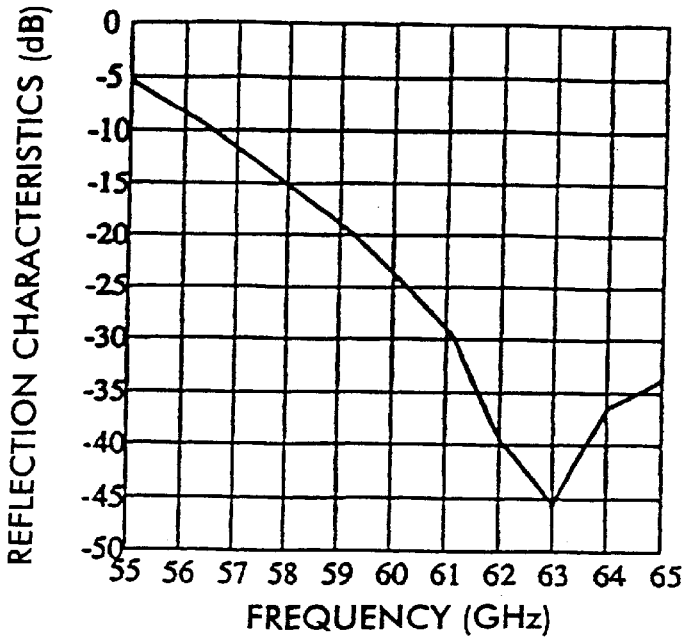
FIG. 17 is a graph showing reflection characteristics of the NRD guide according to the seventh embodiment.

The result of a three dimensional finite-element-method analysis is shown in FIG. 17 under conditions that dimensions shown in FIG. 16 are: a=2.2 mm; b=1.8 mm; g=0.5 mm; i=3.0 mm; and j=1.4 mm, and a specific dielectric constant of the dielectric strip 3 is 2.04. In this manner, excellent reflection characteristics can be obtained in a predetermined frequency band.

Figure 18A:
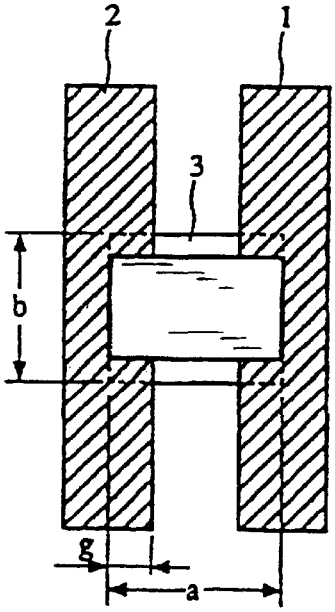
FIGS. 18A and 18B are drawings of a structure of an NRD guide according to an eighth embodiment.
Figure 18B:
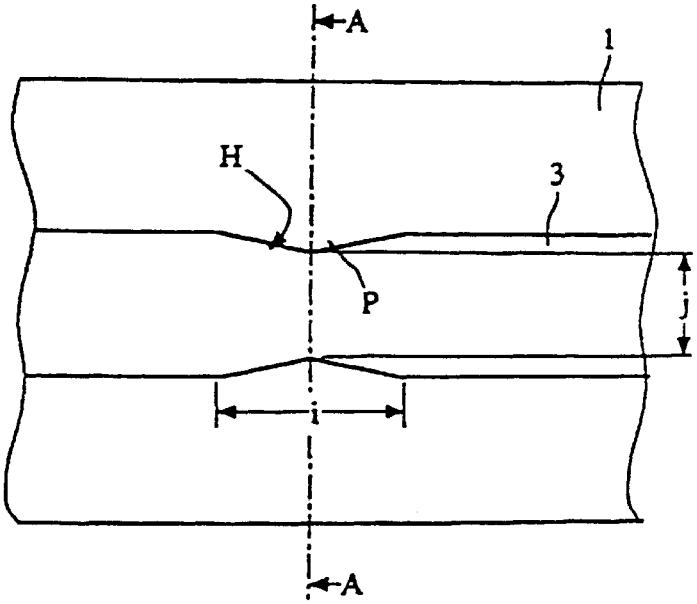
Figure 19:
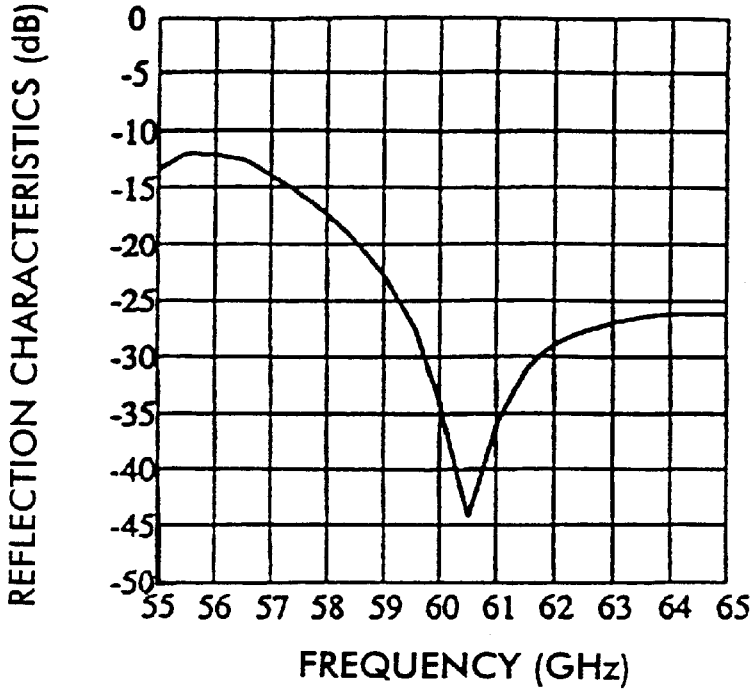
FIG. 19 is a graph showing reflection characteristics of the NRD guide according to the eighth embodiment.

FIG. 18 is a drawing of a structure of an NRD guide according to an eighth embodiment. In this embodiment, the concave portion of the dielectric strip shown in FIG. 16 has a triangular planner shape. The result of a three dimensional finite-element-method analysis is shown in FIG. 19 under conditions that dimensions shown in FIG. 18 are: a=2.2 mm; b=1.8 mm; g=0.5 mm; i=3.0 mm; and j=1.4 mm, and a specific dielectric constant of the dielectric strip 3 is 2.04. In this case, excellent reflection characteristics can be also obtained in a predetermined frequency band.

Figure 20:
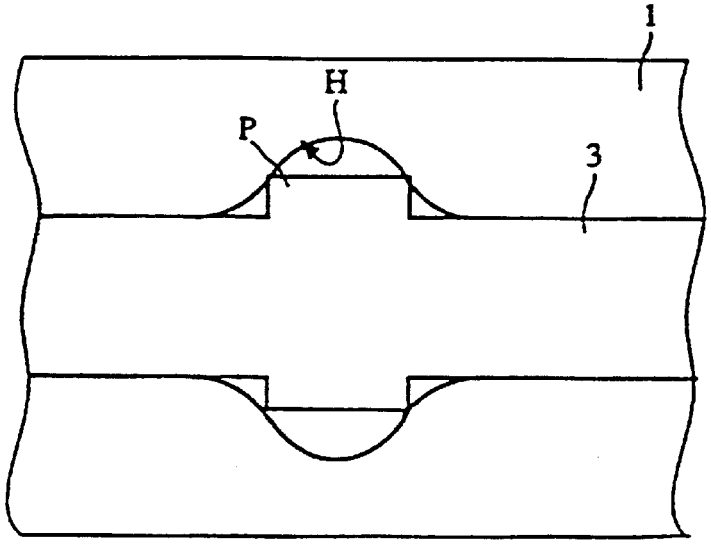
FIG. 20 is a drawing of a structure of an NRD guide according to a ninth embodiment of the present invention.
Figure 21:
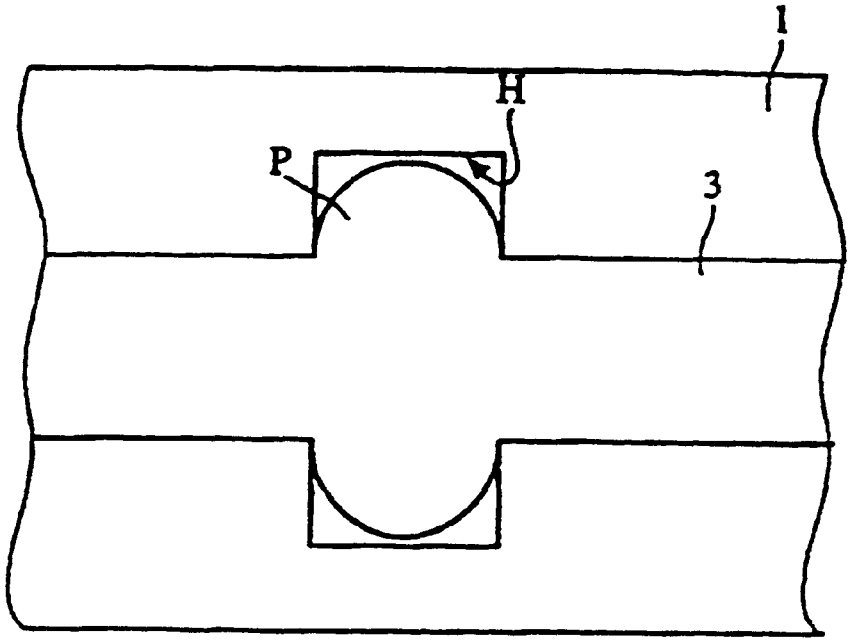
FIG. 21 is a drawing of a structure of an NRD guide according to a tenth embodiment of the present invention.

FIGS. 20 and 21 are drawings of NRD guides according to a ninth and tenth embodiments and respectively show plans thereof when the upper conductive plate is removed. While in the first to the eighth embodiment, the concave portion or the convex portion is formed on the internal surface of the slot of the conductive plate corresponding to the convex portion or concave portion formed in the dielectric strip, the both shapes are not necessarily the same or similar figures, and they may be different from each other as shown in FIGS. 20 and 21. In the case shown in FIG. 20, the convex portion "P" having a rectangular planner shape is formed in the dielectric strip 3 while the concave portion "H" having an approximately semicircular planner shape is formed on the internal surface of the slot of the conductive plate 1, so that part of the convex portion in the dielectric strip 3 is mated with the concave portion in the conductive plate. In the case shown in FIG. 21, the convex portion "P" having a semicircular planner shape is formed in the dielectric strip 3 while the concave portion "H" having a rectangular sectional shape is formed on the internal surface of the slot of the conductive plate. In this case, the root portion of the convex portion "P" in the dielectric strip 3 is mated with the concave portion "H" formed in the slot of the conductive plate.

Then, the structure of an NRD guide according to an eleventh embodiment will be described with reference to FIGS. 22 to 24.

In this embodiment, the effect of the reflection in the connecting portion between the dielectric strips is reduced. FIG. 23 includes a perspective view of a part of the dielectric strip and a side view thereof. As shown in the drawing, the dielectric strip is divided into two portions along the surface parallel to the propagating direction of the electromagnetic wave, and the length of each gap between respective end faces of dielectric strips 31*a* and 32*a* and respective end faces of strips 31*b* and 32*b* is designed to have a length of one-quarter of the guide wavelength or a length which is an odd-number multiple thereof, so that reflecting waves cancel each other out.

Figure 22:
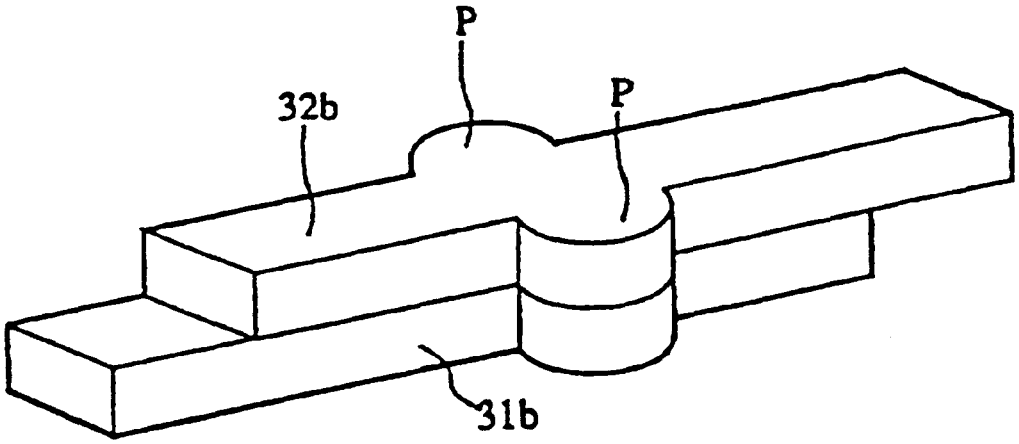
FIG. 22 is a perspective view of a partial structure of a dielectric strip according to an eleventh embodiment.
Figure 23A:
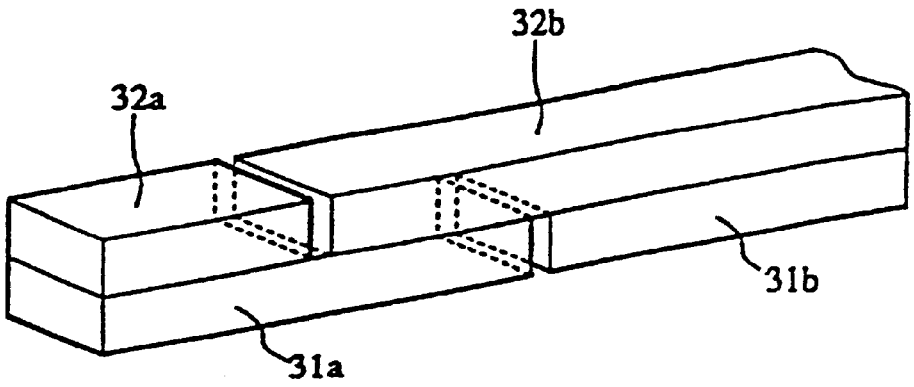
FIGS. 23A and 23B are drawings of a partial structure of the dielectric strip according to the eleventh embodiment.
Figure 23B:
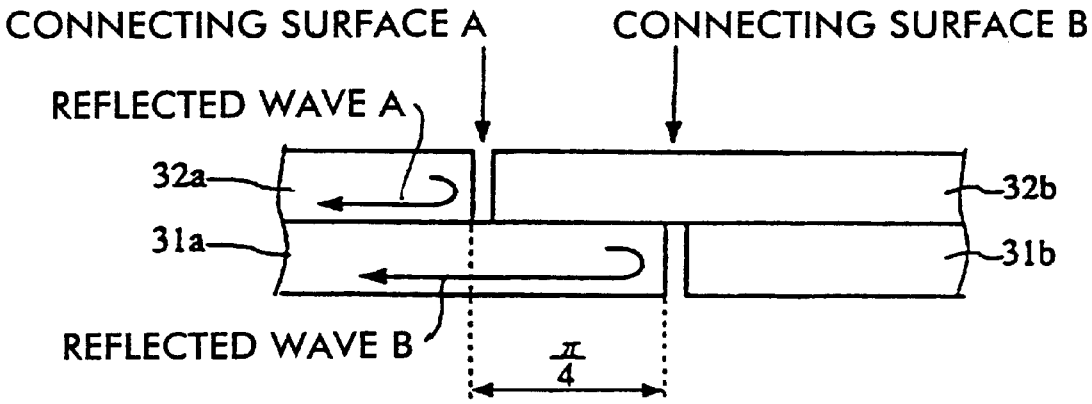

FIG. 22 is a perspective view showing the structure of the fixing portion of the dielectric strips to the conductive plates. In the predetermined portions of the upper and lower dielectric strips 31*b* and 32*b,* convex portions "P" protruding in the lateral direction are formed and corresponding concave portions "H" are respectively formed on internal surfaces of the slots of the upper and lower conductive plates. Owing to this structure, the two upper and lower dielectric strips are fixed to the conductive plates in the predetermined position.

Figure 24A:
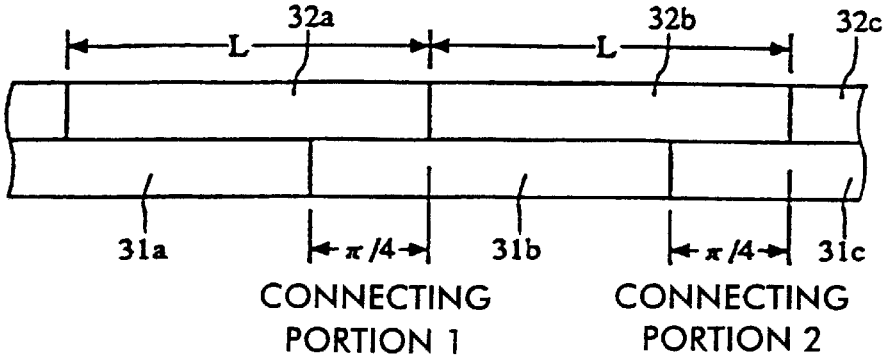
FIGS. 24A to 24C are drawings of states of gaps produced in the connecting surfaces of the dielectric strips according to the eleventh embodiment.
Figure 24B:
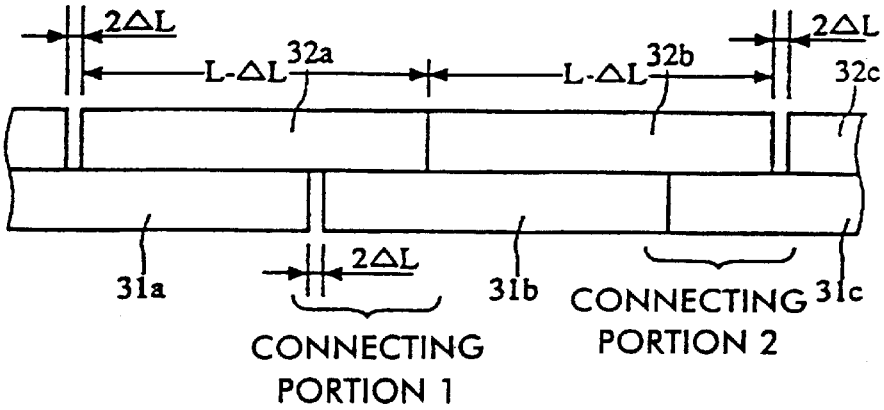
Figure 24C:
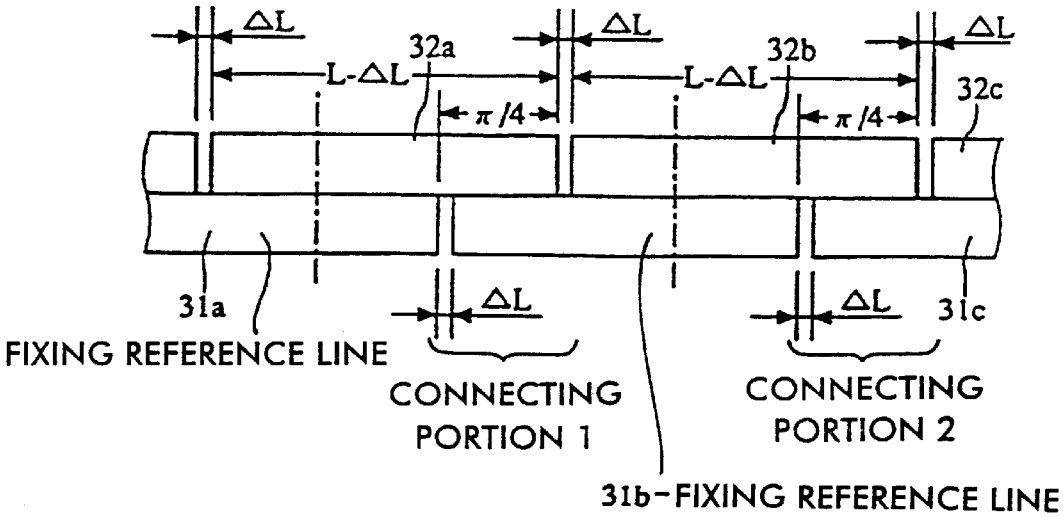

FIG. 24 includes drawings of states of positional slippage when plural combinations of such the pair of dielectric strips shown in FIG. 22 are connected together. FIG. 24(A) shows the state that the length of each gap between end faces of the strips 31*a* and 32*a* and end faces of the strips 31*b* and 32*b* are to have zero at the standard temperature. When each dielectric strip is not fixed, each of gaps between dielectric strips at connecting end faces is not the same, as shown in FIG. 24(B), and difference in the degree of reflection is produced, so that the above-mentioned cancellation of reflected waves by superimposing them out of phase with each other does not always effectively act thereon. Then, as shown in FIG. 24(C), when each dielectric strip is fixed to the conductive plate at approximately intermediate position of the dielectric strip, each gap length "ΔL" between dielectric strips at connecting end faces is the same even when temperature changes, so that the cancellation of reflected waves by superimposing them out of phase effectively acts thereon. In addition, FIG. 22 shows the fixing structure of the dielectric strip to the conductive plate in a fixing reference line shown in the drawing, for example.

Then, a structure of an integrated circuit for millimetric wave radar will be described with reference to FIG. 25.

Figure 25:
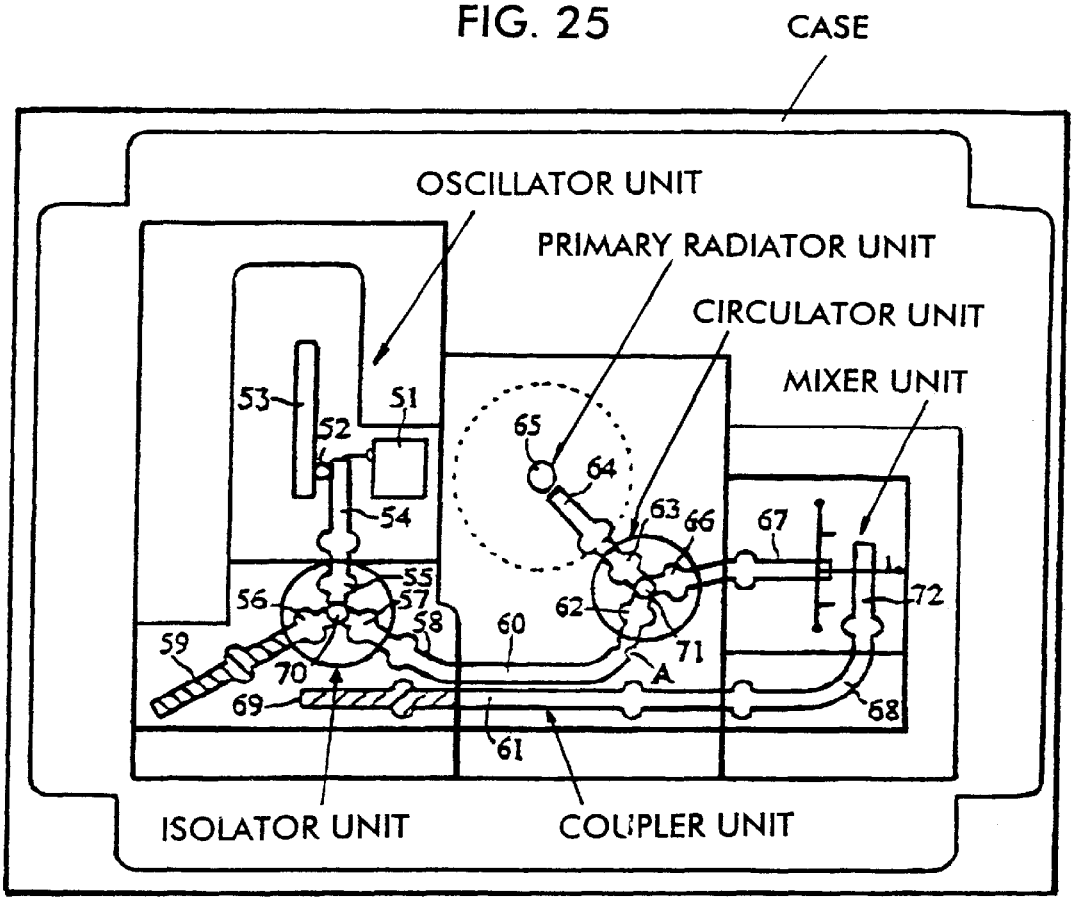
FIG. 25 is a drawing of a structure of an integrated circuit for a millimetric wave radar.
Figure 26:
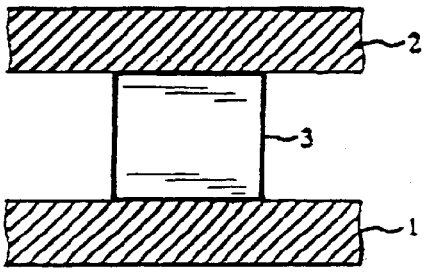
FIG. 26 is a sectional view of a conventional NRD guide.
Figure 27:
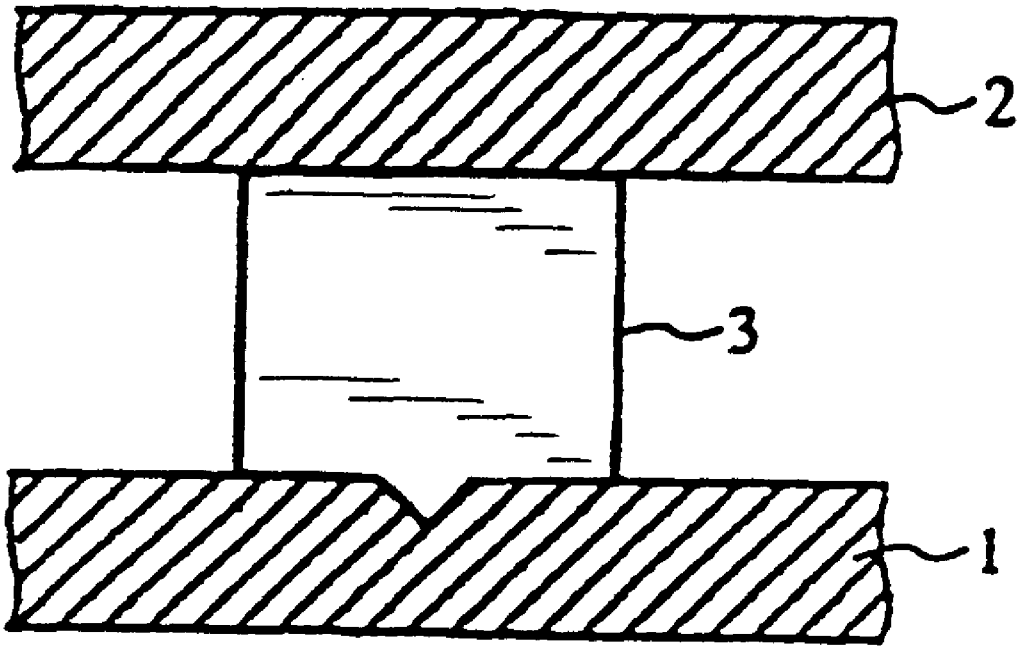
FIG. 27 is a sectional view of a conventional NRD guide.

FIG. 25 is a plan view thereof in a state that the upper conductive plate is removed. This integrated circuit for a millimetric wave radar comprises various components such as an oscillator unit, an isolator unit, a coupler unit, a circulator unit, a mixer unit, and a primary radiator unit and a dielectric lens of an antenna. In the oscillator unit, numeral 51 denotes a Gunn diode block and one electrode of a Gunn diode is connected to a line formed on a substrate. In the oscillator unit, a dielectric strip 53 and a dielectric strip 54 form a sub-line and a main line, respectively. Numeral 52 denotes a dielectric resonator connected with both the lines. Although eliminated in the drawing, a varactor diode is connected to the dielectric strip 53 as the assistant line such that the oscillating frequency of the Gunn diode is controllable. In the isolator unit, dielectric strips 55, 56, and 57 and a terminating set 59 are disposed. In the central portion of the three dielectric strips 55, 56, and 57, a ferite resonator 70 is disposed to form a circulator. The circulator and the terminating set 59 form an isolator. In the coupler unit, dielectric strips 60 and 61 form a coupler. In the circulator unit, dielectric strips 62, 63, and 66 and a ferite resonator 71 form a circulator. In the primary radiator unit, a dielectric strip 64 and a dielectric resonator 65 as a primary radiator are disposed. Furthermore, in the mixer unit, dielectric strips 67, 68, and 72 are disposed and a conductive pattern generating an IF signal (intermediate-frequency signal) by mixing an RF signal (receiving-frequency signal) and an Lo signal (local signal) together and a mixer diode are arranged on the substrate. The oscillating signal generated by the Gunn diode block 51 is transmitted through the path of the dielectric strip 54→the isolator unit→the dielectric strip 60→the circulator unit→the primary radiator unit so as to be radiated via the dielectric lens. The receiving-frequency signal is transmitted through the path of the dielectric lens→the primary radiator unit→the circulator unit→the mixer unit, while the Lo signal is transmitted through the path of the coupler unit→the mixer unit.

As shown in FIG. 25, in each dielectric strip and each terminating set, mating portions (convex portions) mating with internal surfaces of the slots of the conductive plates are formed at predetermined positions while corresponding concave portions are formed on internal surfaces of the slots of the upper and lower conductive plates. Therefore, these dielectric strips and terminating sets are positioned and fixed in the propagating direction of the electromagnetic wave. When the dielectric strip and the terminating set expand and contract in accordance with variations in ambient temperature, the gap between the dielectric strips at the connecting portion between components is produced to be determined directly and exclusively. Accordingly, variations in characteristics due to variations in assembly accuracy and variations in temperature are easily kept within a predetermined range.

In addition, the mating position in each dielectric strip may be designed in consideration of productivity of the dielectric strip and variations in characteristics due to changes in temperature. Whether convex or concave portions formed in the lateral direction of the dielectric strip may also depend on productivity and variations in characteristics. For example, when convex portions protruding in the lateral direction are formed in a bend portion, the portion becomes a propagating area in the LSE01 mode. In order to prevent a loss involved in the mode conversion from the LSM01 mode to the LSE01 mode, concave portions recessed in the lateral direction of the dielectric strip may be formed therein, as shown by "A" in FIG. 25. When the mating portion is formed at positions except the bend portion, the convex portions protruding in the lateral direction of the dielectric strip may be formed therein such that processing of the slot of the conductive plate is easy and the strength of the dielectric strip can be maintained.

According to an aspect of the invention described above, since the dielectric strip is fixed in the propagating direction of the electromagnetic wave by mating of the convex portions or the concave portions of the dielectric strip with internal surface of the slots of the conductive plates, even when the dielectric strip and the slots of the conductive plates are produced by machining, etc., the process is easily performed. Since the convex portions or the concave portions of the dielectric strip 3 are formed in the lateral direction thereof, the electromagnetic field distribution in a mode to be propagated can be scarcely disturbed.

According to another aspect of the invention described above, for example, when the dielectric strip is cut from a dielectric plate with an end mill, the dielectric strip having the concave portions or the convex portions with corner portions having a curved surface shape can be easily processed corresponding to the radius of the end mill. Likewise, when the slot of the conductive plate is formed with the end mill, the concave portion or convex portion with corner portions having a curved surface shape can be easily formed on the internal surface of the slot of the conductive plate corresponding to the radius of the end mill.

According to a further aspect of the invention described above, in the connecting portion of non-radiative dielectric lines, reflected waves in each connecting surface between the dielectric strips cancel each other by being superimposed out of phase with each other, such that the effect of the reflection is reduced. Even when the two divided dielectric strips move relative to the conductive plates due to variations in temperature, since the length of each gap produced therein is the same, the effect of the reflection is reduced regardless of variations in ambient temperature.

According to yet another aspect of the invention described above, since the positional relationship between plural non-radiative dielectric lines can be maintained to be stable, an integral circuit having small variations in characteristics due to variations in assembly accuracy and to variations in ambient temperature after assembling can be obtained.

INDUSTRIAL APPLICABILITY

As understood by the above description, a non-radiative dielectric line and an integrated circuit thereof according to the present invention are applied to the production of wide-ranging electronic apparatuses such as millimetric-wave frequency-band radio communication apparatus and a microwave-frequency-band radio communication apparatus.

What is claimed is:

1. A non-radiative dielectric line comprising:

two conductive plates approximately parallel to each other, slots opposing each other being respectively formed on said two conductive plates; and a dielectric strip disposed between both the slots, wherein convex portions protruding in the lateral direction to the propagating direction of an electromagnetic wave or concave portions recessed in the lateral direction to the propagating direction of an electromagnetic wave are formed at a predetermined position of said dielectric strip while concave portions or convex portions mating with the convex portions or the concave portions, respectively, of said dielectric strip are formed on internal surfaces of the slots in said two conductive plates.

2. A non-radiative dielectric line according to claim 1, wherein corner portions of the concave portions or the convex portions in said dielectric strip or in the slots of said two conductive plates have a curved surface shape.

3. A non-radiative dielectric line according to claim 2, wherein said dielectric strip is divided into two strips along a surface parallel to the propagating direction of the electromagnetic wave, wherein a gap between end faces of the two divided dielectric strips has a length which is an odd-number multiple of approximately one-quarter of the guide wavelength of the electromagnetic wave propagating through said dielectric strip while the two divided dielectric strips are respectively mated with said two conductive plates by the convex portions or the concave portions.

4. A non-radiative dielectric line according to claim 1, wherein said dielectric strip is divided into two strips along a surface parallel to the propagating direction of the electromagnetic wave, wherein a gap between end faces of the two divided dielectric strips has a length which is an odd-number multiple of approximately one-quarter of the guide wavelength of the electromagnetic wave propagating through said dielectric strip while the two divided dielectric strips are respectively mated with said two conductive plates by the convex portions or the concave portions.

5. A non-radiative dielectric line integrated circuit, comprising at least one non-radiative dielectric (NRD) line according to claim 1.

6. An integrated circuit according-to claim 5, wherein said at least one NRD line comprises a plurality of NRD lines which are connected together, each said NRD line comprising:

two conductive plates approximately parallel to each other, slots opposing each other being respectively formed on said two conductive plates; and a dielectric strip disposed between both the slots, wherein convex portions protruding in the lateral direction to the propagating direction of an electromagnetic wave or concave portions recessed in the lateral direction to the propagating direction of an electromagnetic wave are formed at a predetermined position of said dielectric strip while concave portions or convex portions mating with the convex portions or the concave portions, respectively, of said dielectric strip are formed on internal surfaces of the slots in said two conductive plates.

7. An integrated circuit according to claim 6, wherein corner portions of the concave portions or the convex portions in said dielectric strip or in the slots of said two conductive plates have a curved surface shape.

8. An integrated circuit according to claim 7, wherein said dielectric strip is divided into two strips along a surface parallel to the propagating direction of the electromagnetic wave, wherein a gap between end faces of the two divided dielectric strips has a length which is an odd-number multiple of approximately one-quarter of the guide wavelength of the electromagnetic wave propagating through said dielectric strip while the two divided dielectric strips are respectively mated with said two conductive plates by the convex portions or the concave portions.

9. An integrated circuit according to claim 6, wherein said dielectric strip is divided into two strips along a surface parallel to the propagating direction of the electromagnetic wave, wherein a gap between end faces of the two divided dielectric strips has a length which is an odd-number multiple of approximately one-quarter of the guide wavelength of the electromagnetic wave propagating through said dielectric strip while the two divided dielectric strips are respectively mated with said two conductive plates by the convex portions or the concave portions.

* * * * *